US009118156B2

(12) United States Patent
Huang

(10) Patent No.: US 9,118,156 B2
(45) Date of Patent: Aug. 25, 2015

(54) COAXIAL CONNECTOR

(71) Applicant: Chung-Chuan Huang, Tainan (TW)

(72) Inventor: Chung-Chuan Huang, Tainan (TW)

( * ) Notice: Subject to any disclaimer, the term of this patent is extended or adjusted under 35 U.S.C. 154(b) by 107 days.

(21) Appl. No.: 14/084,784

(22) Filed: Nov. 20, 2013

(65) Prior Publication Data

US 2015/0140859 A1 May 21, 2015

(51) Int. Cl.
*H01R 12/00* (2006.01)
*H01R 24/40* (2011.01)

(52) U.S. Cl.
CPC ..... *H01R 24/40* (2013.01)

(58) Field of Classification Search
CPC ..... H01R 4/28; H01R 9/05; H01R 9/0515; H01R 12/721; H01R 24/50; H01R 13/627; H01R 13/6275; H01P 5/085
USPC ..... 439/578, 63, 78, 345, 581; 174/75 C
See application file for complete search history.

(56) References Cited

U.S. PATENT DOCUMENTS

| | | | | |
|---|---|---|---|---|
| 3,514,737 | A * | 5/1970 | Harold, Jr. | 439/63 |
| 6,106,304 | A * | 8/2000 | Huang | 439/63 |
| 6,358,062 | B1 * | 3/2002 | Feldman et al. | 439/63 |
| 6,811,405 | B1 * | 11/2004 | Huang | 439/63 |
| 7,690,922 | B2 * | 4/2010 | Huang | 439/63 |
| 7,713,067 | B1 * | 5/2010 | Behrent | 439/63 |
| 8,035,466 | B2 * | 10/2011 | Payne | 333/260 |

* cited by examiner

*Primary Examiner* — Vanessa Girardi
(74) *Attorney, Agent, or Firm* — Rosenberg, Klein & Lee

(57) ABSTRACT

A coaxial connector includes an inner tube, an outer tube, a center connector unit and a resilient member. The inner and outer tube each have a first/second body, and each of the first and second bodies has a semi-circular first/second tubular portion. A first flange extends outward from the front end of the first tubular portion. The outer tube has a first stepped portion formed in the inside of the front end of the second tubular portion thereof. The center connector unit is securely located in the first and second bodies. The resilient member has a curved body with two legs bent from two ends thereof. The curved body of the resilient member is engaged between the first flange and the first stepped portion. The legs extend beyond the first and second tubular portions. The coaxial connector is easily assembled and has lower manufacturing cost.

5 Claims, 7 Drawing Sheets

COAXIAL CONNECTOR

BACKGROUND OF THE INVENTION

1. Fields of the Invention

The present invention relates to a coaxial connector, and more particularly, to a coaxial connector for transmission of electric signals. The coaxial connector is easily assembled and has lower manufacturing cost.

2. Descriptions of Related Art

The conventional way to connect a connector with a circuit board is directly connecting the connector to the contact point of the circuit board by way of welding.

However, the connection between the connector and the contact point of the circuit board often is not well connected so that the transmission is affected. Taiwan Utility Model No. 215421 discloses a coaxial connector 10 which is disclosed in FIG. 1 and comprises a semi-circular contact portion 101 on the front end thereof. A semi-circular opening 102 is formed at the lower portion of the contact portion 101. A notch 103 is defined between the semi-circular contact portion 101 and the semi-circular opening 102. A center connector 104 extends centrally and axially from the coaxial connector 10. A curved slot 105 is defined in the inside of the contact portion 101 and a C-shaped leg 106 is engaged with the curved slot 105. As shown in FIG. 2, when the coaxial connector 10 is connected to the circuit board 20, the notch 103 is aligned with the side of the circuit board 20, the coaxial connector 10 is then rotated to insert the C-shaped leg 106 into the holes 201 of the circuit board 20. The center connector 104 is then connected with the holes 201 of the circuit board 20.

It is noted that the material, cupper, for making the coaxial connector becomes rare and expensive along with the huge demand globally, so that the cost for the coaxial connector is a burden for the manufacturers and users.

In order to reduce the cost of the use of the cupper, casting iron is chosen to replace the cupper, and the structure of the coaxial connector has to be changed by the use of the casting iron.

The present invention intends to provide a coaxial connector which has different structure from that of the conventional coaxial connector and improves the shortcomings mentioned above.

SUMMARY OF THE INVENTION

The present invention relates to a coaxial connector and comprises an inner tube, an outer tube, a center connector unit and a resilient member. The inner tube has a first body on the front end thereof. The outer tube has a second body on the front end thereof. Each of the first and second bodies is a tubular body and the center connector unit is located in the first and second bodies. Each of the first and second bodies has a semi-circular first/second tubular portion. A first flange extends outward from the front end of the first tubular portion, and a second flange extends from the inside of the conjunction area between the first body and the first tubular portion. The outer tube has a first stepped portion formed in the inside of the front end of the second tubular portion thereof. The outer tube has a neck extending inward from the rear end of the second body. The resilient member has a curved body and two legs are bent from two ends of the curved body of the resilient member. The curved body of the resilient member is engaged with the area between the first flange and the first stepped portion. The legs extend beyond the first and second tubular portions.

Preferably, the center connector unit comprises a center connector, a first insulator and a second insulator. The center connector has a solid transmission end on the front end thereof. A hollow insertion end is formed on the rear end of the center connector. A first restriction portion and a second restriction portion are formed between the transmission end and the insertion end. The second restriction portion is located close to the insertion end and at a distance from the first restriction portion. The first insulator has a through hole in the middle portion thereof and the center connector extends through the through hole. The first insulator has a second stepped portion. The second flange contacts the second stepped portion. The second insulator has a cylindrical body and has a sleeve extending therefrom. The sleeve has an end face which contacts the second restriction portion. The sleeve has a hollow portion which extends through the second insulator and the insertion end is inserted into the hollow portion.

Preferably, the first tubular portion of the inner tube has a ridge extending axially from the outside thereof. The outer tube has a groove defined axially in the inside thereof. The ridge is located corresponding to the groove. The resilient member has a notch which is located corresponding to the ridge. Two respective widths of the ridge and the groove are narrowed toward the second body.

Preferably, the first body of the inner tube has a rough surface formed on the outside thereof and the rough surface is located close to the first tubular portion. The rough surface is in contact with the inside of the second body of the outer tube.

Preferably, two blocks respectively extend from two ends of the first flange. The resilient member has two protrusions extending therefrom. The blocks and the protrusions contact the underside of the second tubular portion of the outer tube.

The primary object of the present invention is to provide a coaxial connector which is easily assembled and has lower manufacturing cost.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
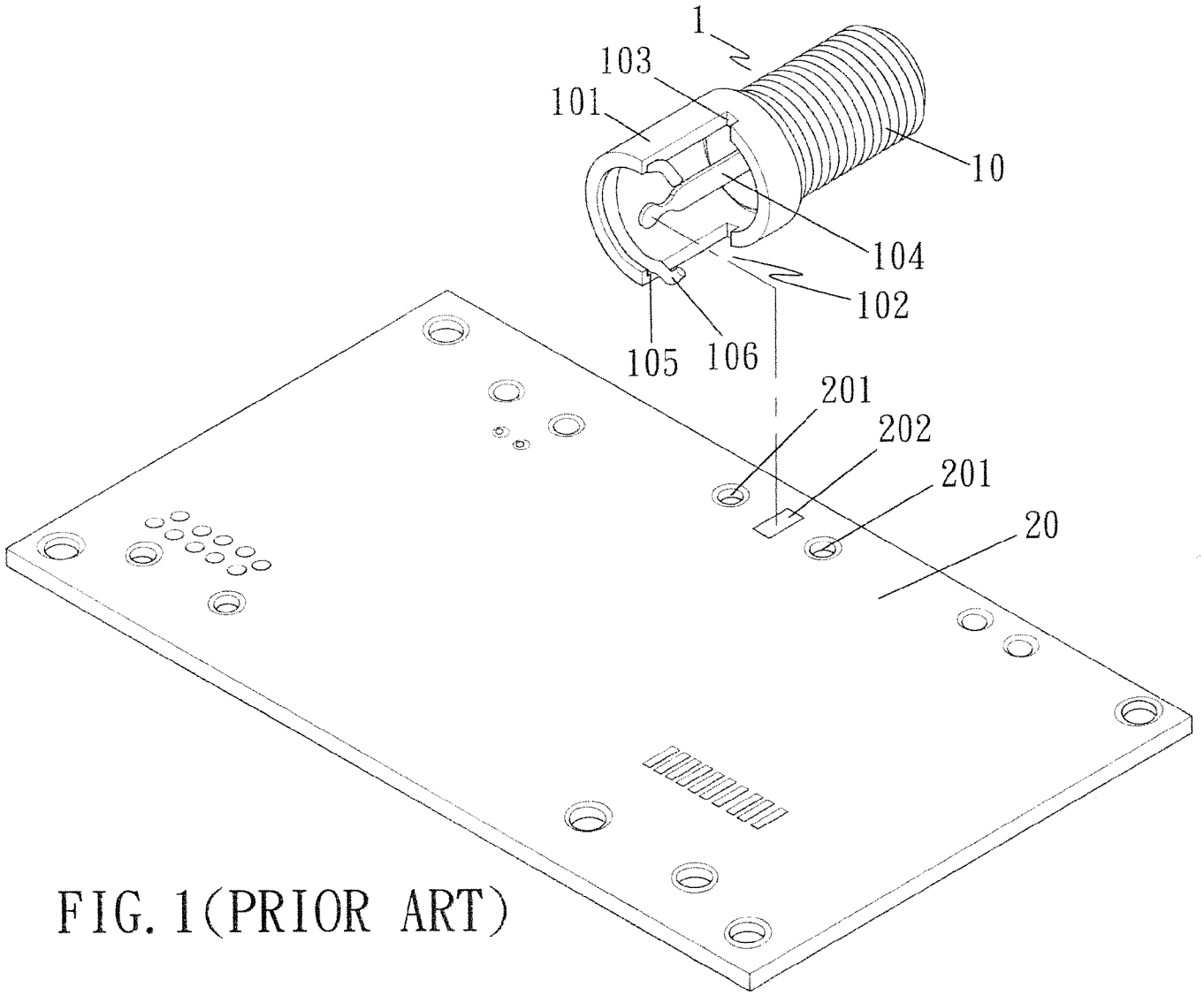
FIG. 1(PRIOR ART)
FIG. 1 shows the conventional coaxial connector and a circuit board.
Figure 2:
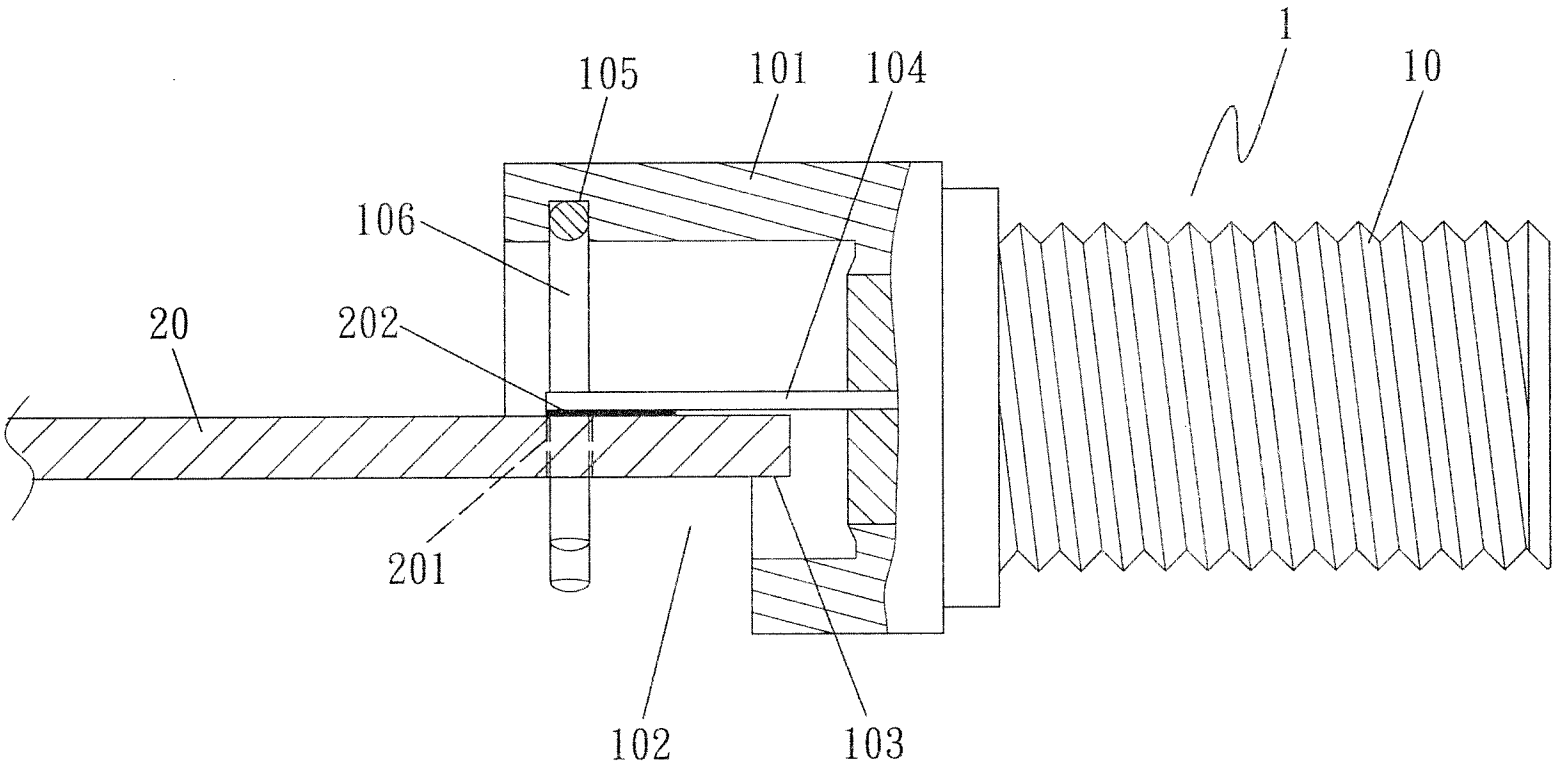
FIG. 2(PRIOR ART)
FIG. 2 shows the conventional coaxial connector connected to the circuit board.
Figure 3:
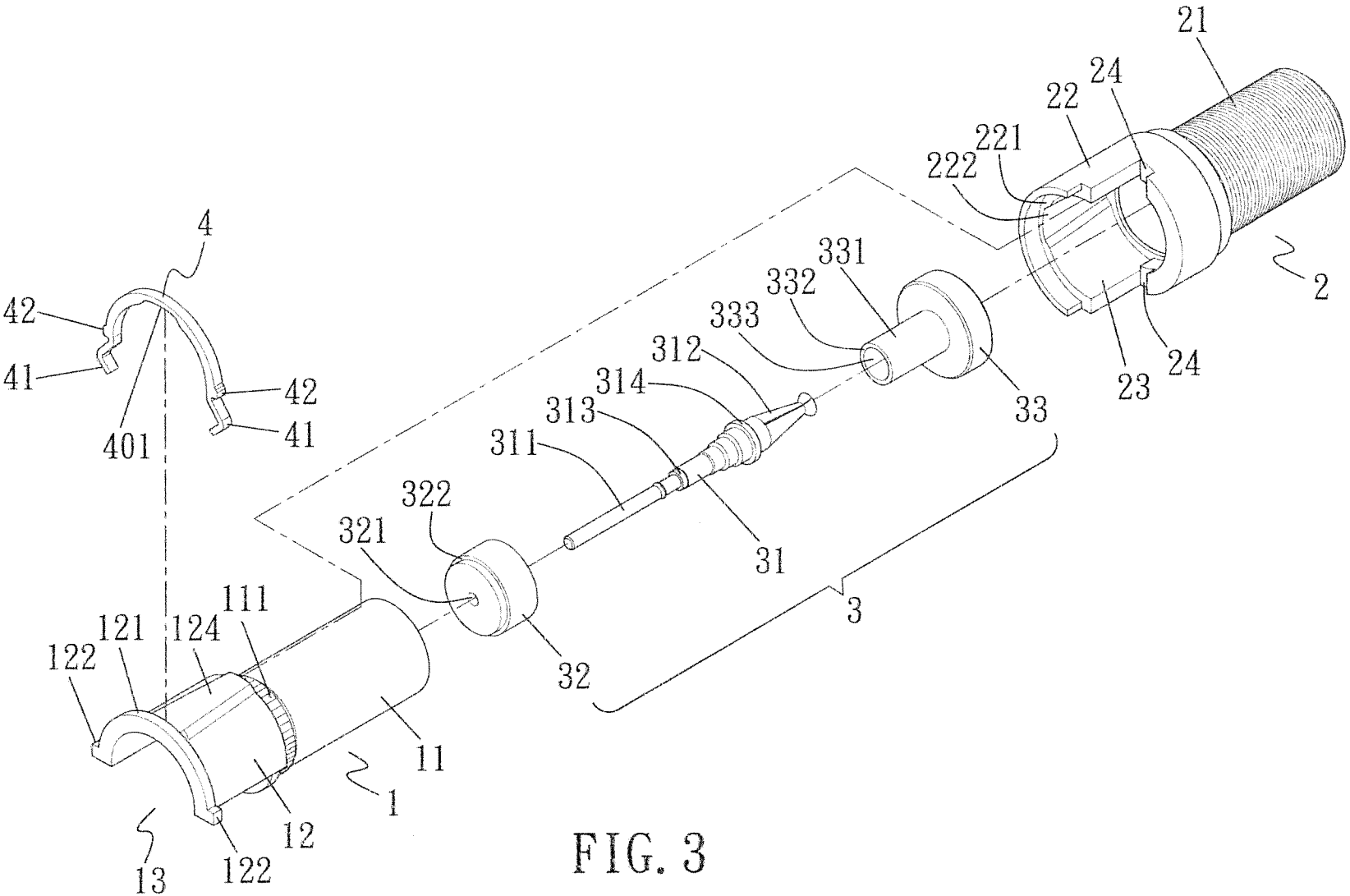
FIG. 3 is an exploded view of the coaxial connector of the present invention.
Figure 4:
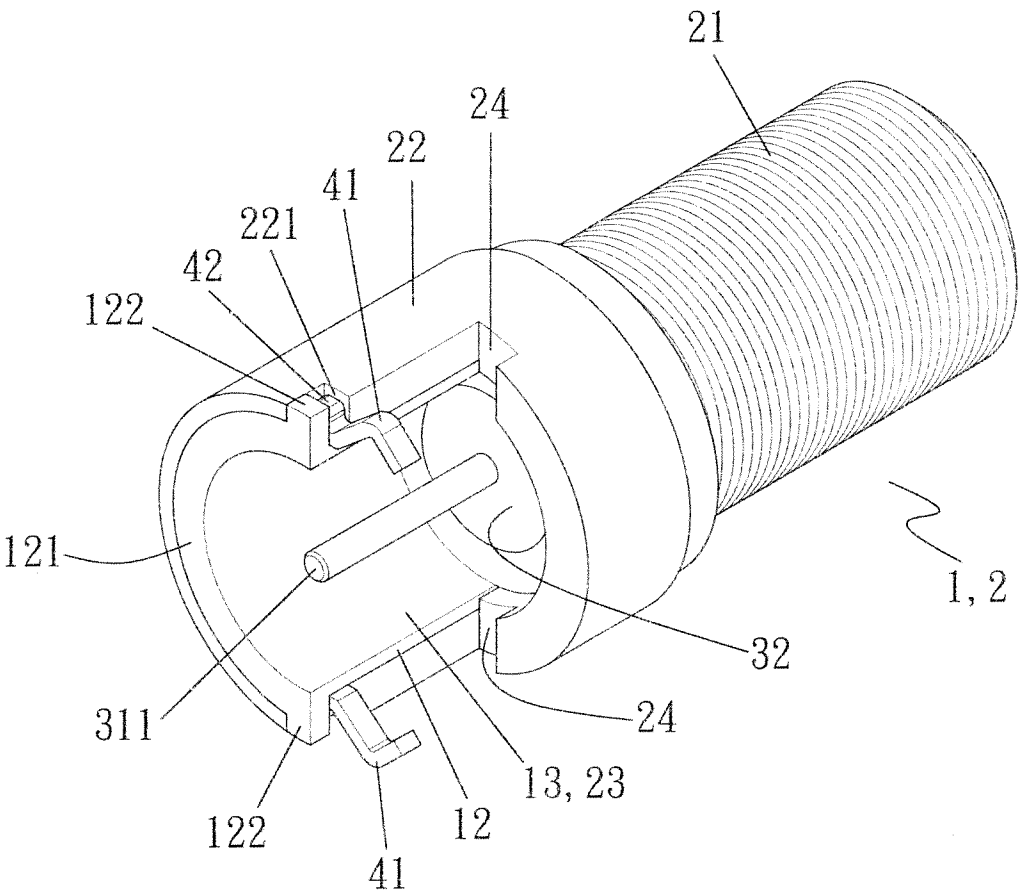
FIG. 4 is a perspective view to show the coaxial connector of the present invention.
Figure 5:
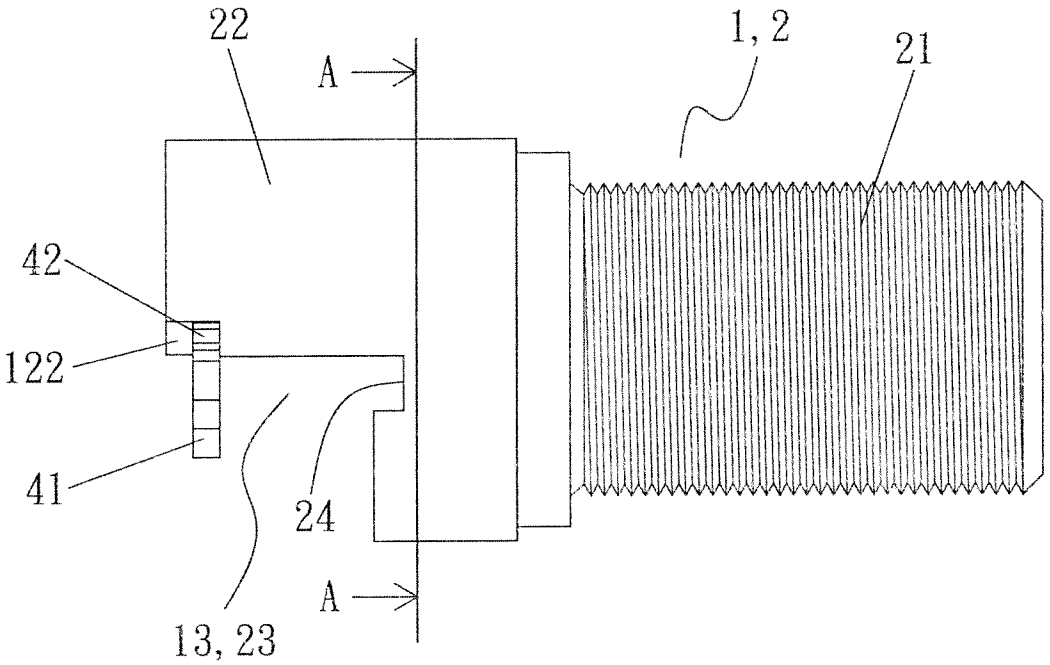
FIG. 5 is a side view of the coaxial connector of the present invention.
Figure 6:
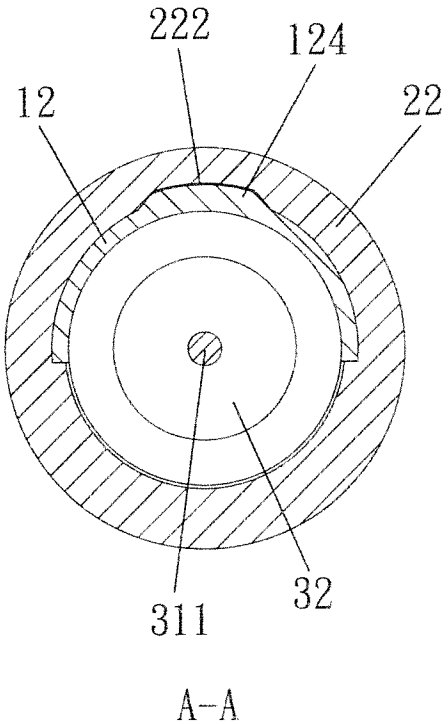
FIG. 6 is a cross sectional view, taken along ling A-A in FIG. 5.
Figure 8:
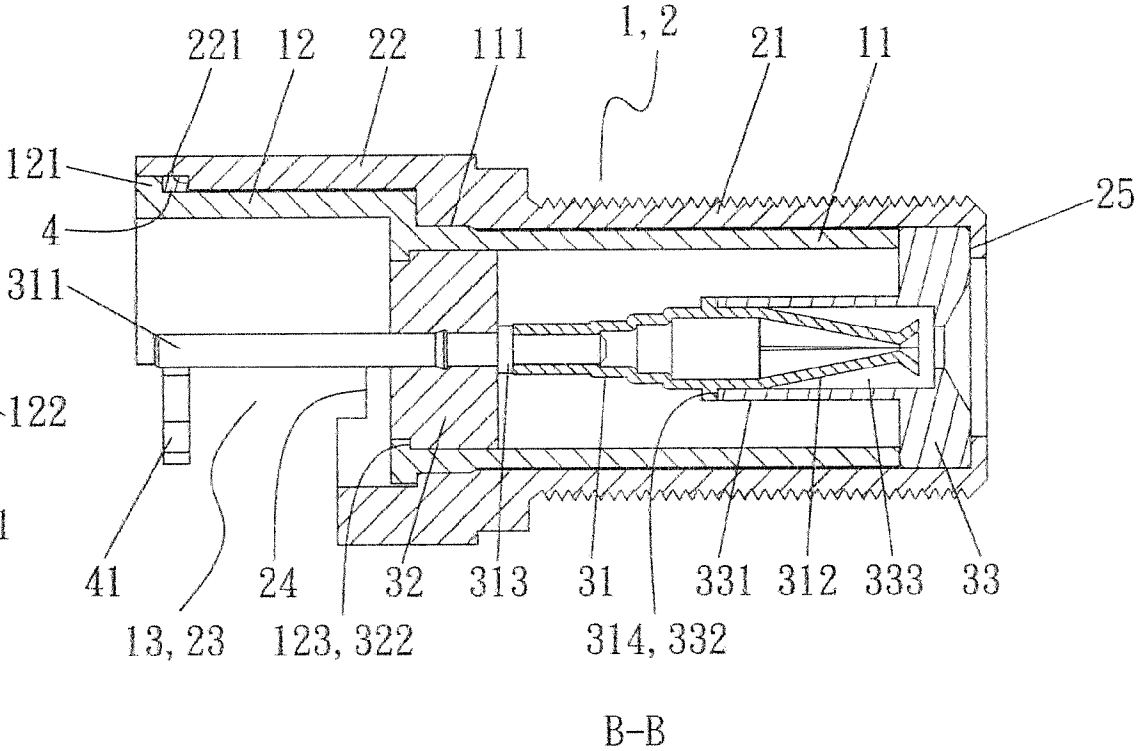
FIG. 8 is a cross sectional view, taken along ling B-B in FIG. 7.
Figure 7:
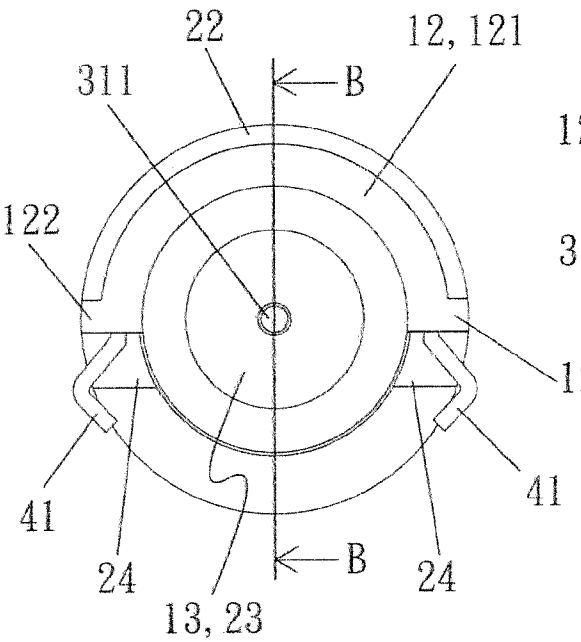
FIG. 7 is an end view of the coaxial connector of the present invention.

Referring to FIGS. 3 to 8, the coaxial connector of the present invention comprises an inner tube 1, an outer tube 2, a center connector unit 3 and a resilient member 4.

The inner tube 1 is made by conductive metal, except for cupper, by way of compression casting, and has a first body 11 on the front end thereof. The first body 11 has a semi-circular first tubular portion 12. The first body 11 of the inner tube 1 has a rough surface 111 formed on the outside thereof and the rough surface 111 is located close to the first tubular portion 12. A semi-circular opening 13 is defined at the lower portion of the first tubular portion 12. A first flange 121 extends outward from the front end of the first tubular portion 12 and two blocks 122 extend from two ends of the first flange 121. A second flange 123 extends from the inside of the conjunction area between the first body 11 and the first tubular portion 12. The first tubular portion 12 of the inner tube 1 has a ridge 124 extending axially from the outside thereof, and the width of the ridge 124 is gradually narrowed toward the first body 11.

The outer tube 2 is made by conductive metal, except for cupper, by way of compression casting, and has a second body 21 on the front end thereof. The second body 21 has a semi-circular second tubular portion 22. A semi-circular opening 23 is defined at the lower portion of the second tubular portion 22. A notch 24 is defined at the conjunction corner of the second tubular portion 22 and the opening 23. The outer tube 2 has a first stepped portion 221 formed in the inside of the front end of the second tubular portion 22 thereof. The outer tube 2 has a neck 25 extending inward from the rear end of the second body 21. The outer tube 2 has a groove 222 defined axially in the inside thereof, the ridge 124 is located corresponding to the groove 222. The width of the groove 222 is gradually narrowed toward the second body 21.

The center connector unit 3 is made by metal, by way of compression casting, and comprises a center connector 31, a first insulator 32 and a second insulator 33. The center connector 31 has a solid transmission end 311 on the front end thereof. A hollow insertion end 312 is formed on the rear end of the center connector 31. A first restriction portion 313 and a second restriction portion 314 are formed between the transmission end 311 and the insertion end 312. The second restriction portion 314 is located close to the insertion end 312 and at a distance from the first restriction portion 313. The first insulator 32 has a through hole 321 in the middle portion thereof and the center connector 31 extends through the through hole 321. The first insulator 32 has a second stepped portion 322, and the second flange 123 contacts the second stepped portion 322. The second insulator 33 has a cylindrical body and has a sleeve 331 extending therefrom. The sleeve 331 has an end face 332 which contacts the second restriction portion 314. The sleeve 331 has a hollow portion 333 which extends through the second insulator 33 and the insertion end 312 is inserted into the hollow portion 333.

The resilient member 4 is made by metal and by way of compression casting, and has a curved body and two legs 41 bent from two ends of the curved body of the resilient member 4. The curved body of the resilient member 4 is engaged with an area between the first flange 121 and the first stepped portion 221. The legs 41 extending beyond the first and second tubular portions 12, 22. The resilient member 4 has two protrusions 42 extending therefrom and the two protrusions 42 are located between the two legs 41.

As shown in FIGS. 4 to 8, when assembling, the center connector 31 extends through the through hole 321 of the first insulator 32 to expose the transmission end 311 beyond the first insulator 32 and to be located on the same face of the second stepped portion 322, until the first restriction portion 313 contacts the first insulator 32. Besides, the sleeve 331 of the second insulator 33 is mounted to the insertion end 312 of the center connector 31, until the second restriction portion 314 contacts the end face 332 of the sleeve 331. The center connector unit 3 is then formed.

The first insulator 32 of the center connector unit 3 is inserted into the distal end of the inner tube 1 until the second stepped portion 322 contacts the second flange 123 of the inner tube 1, and the second insulator 33 contacts the distal end of the inner tube 1 to allow the center connector unit 3 to be initially connected to the inner tube 1.

The resilient member 4 is then mounted to the first tubular portion 12 of the inner tube 1 to engage the ridge 124 with the notch 401. The ridge 124 on the outside of the first tubular portion 12 is then located in alignment with the groove 222 of the second tubular portion 22 of the outer tube 2, and the combination of the inner tube 1, the center connector unit 3 and the resilient member 4 is inserted into the outer tube 2. The second insulator 33 of the center connector unit 3 contacts the beck 25 of the outer tube 2, and the resilient member 4 and the first flange 121 of the inner tube are merged in the first stepped portion 221 of the outer tube 2. The center connector unit 3 is then insulated from the inner and outer tube 1, 2 by engaging the first and second insulators 32, 33 with the second flange 123 of the inner tube 1 and the neck 25 of the outer tube 2. The resilient member 4 is secured between the first flange 121 of the inner tube 1 and the first stepped portion 221 of the outer tube 2. The protrusions 42 of the resilient member 4 and the blocks 122 of the inner tube 1 contact the second tubular portion 22 of the outer tube 2. The legs 41 of the resilient member 4 extend beyond the first and second tubular portions 12, 22, and the rough surface 111 is securely engaged with the inside of the second body 21 of the outer tube 2 so securely position the resilient member 4 between the inner and outer tubes 1, 2. Therefore, the resilient member 4 does not shake and the two legs 41 have the same length. The inner and outer tubes 1, 2 and the resilient member 4 is well connected to each other as shown in FIGS. 4 to 8.

Figure 9:
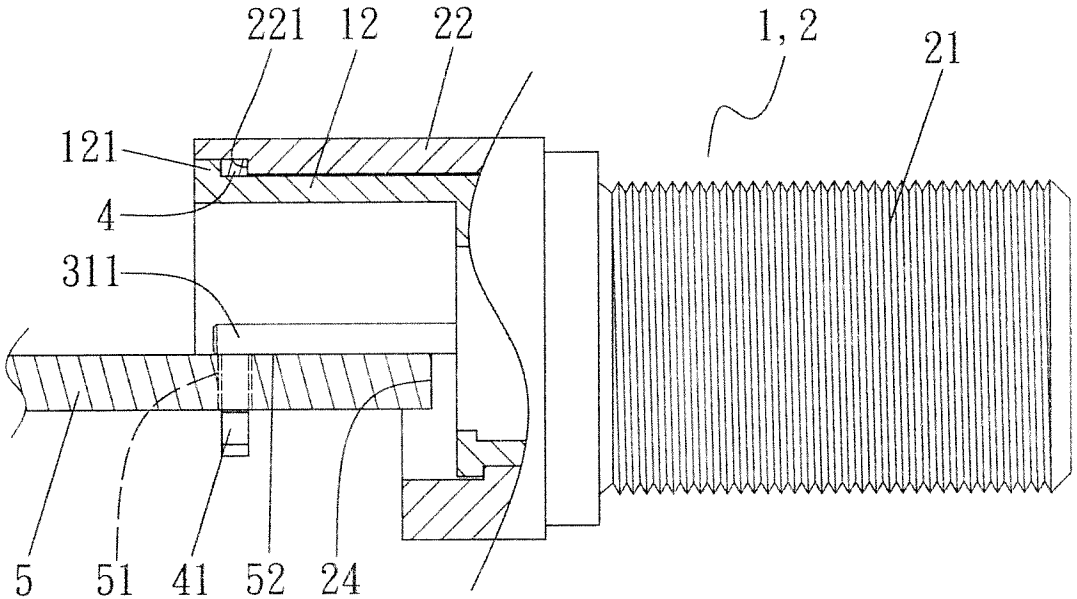
FIG. 9 shows that the coaxial connector of the present invention is connected with a circuit board.

As shown in FIG. 9, the coaxial connector is connected to the circuit board 5 is first to engage one side of the circuit board 5 with the notch 24, the axial connector is then rotated to insert the two legs 42 of the resilient member 4 into the holes 51 in the circuit board 5. The first and second tubular portions 12, 22 of the inner and outer tubes 1, 2 contact the surface of the circuit board 5 so that the legs 42 are not separated from the circuit board 5, and the transmission end 311 is well in contact with the contact point 52 of the circuit board 5.

The present invention uses less expensive material to replace the cupper to improve the problem of higher manufacturing cost. The center connector 31 and the resilient member 4 are well positioned between the inner and outer tubes 1, 2, and the cooperation between the second flange 123 and the second stepped portion 322, the first restriction portion 313 and the first insulator 32, the second restriction portion 314 and the end face 332, and the second insulator 33 and the neck 25 to secure the center connector 31, and the inner and outer tubes 1, 2. By the cooperation between the first flange 121 and the first stepped portion 221, between the ridge 124, the groove 222 and the notch 401, and between the blocks 122 and protrusions 42, the inner tube 1, the outer tube 2 and the resilient member 4 are well positioned. The present invention is easily precisely assembled.

While we have shown and described the embodiment in accordance with the present invention, it should be clear to those skilled in the art that further embodiments may be made without departing from the scope of the present invention.

What is claimed is:

1. A coaxial connector comprising:

an inner tube, an outer tube, a center connector unit and a resilient member, the inner tube having a first body on a front end thereof, the outer tube having a second body on a front end thereof, each of the first and second bodies being a tubular body and the center connector unit located in the first and second bodies, each of the first and second bodies having a semi-circular first/second tubular portion, a first flange extending outward from a front end of the first tubular portion, a second flange extending from an inside of a conjunction area between the first body and the first tubular portion, the outer tube having a first stepped portion formed in an inside of a front end of the second tubular portion thereof, the outer tube having a neck extending inward from a rear end of the second body, the resilient member having a curved body and two legs bent from two ends of the curved body of the resilient member, the curved body of the resilient member engaged with an area between the first flange and the first stepped portion, the legs extending beyond the first and second tubular portions.

2. The coaxial connector as claimed in claim 1, wherein the center connector unit comprises a center connector, a first insulator and a second insulator, the center connector has a solid transmission end on a front end thereof, a hollow insertion end is formed on a rear end of the center connector, a first restriction portion and a second restriction portion are formed between the transmission end and the insertion end, the second restriction portion is located close to the insertion end and at a distance from the first restriction portion, the first insulator has a through hole in a middle portion thereof and the center connector extends through the through hole, the first insulator has a second stepped portion, the second flange contacts the second stepped portion, the second insulator has a cylindrical body and has a sleeve extending therefrom, the sleeve has an end face which contacts the second restriction portion, the sleeve has a hollow portion which extends through the second insulator and the insertion end is inserted into the hollow portion.

3. The coaxial connector as claimed in claim 1, wherein the first tubular portion of the inner tube 1 has a ridge extending axially from an outside thereof, the outer tube has a groove defined axially in an inside thereof, the ridge is located corresponding to the groove, the resilient member has a notch which is located corresponding to the ridge, two respective widths of the ridge and the groove are narrowed toward the first/second body.

4. The coaxial connector as claimed in claim 1, wherein the first body of the inner tube has a rough surface formed on an outside thereof and the rough surface is located close to the first tubular portion, the rough surface is in contact with the inside of the second body of the outer tube.

5. The coaxial connector as claimed in claim 1, wherein two blocks respectively extend from two ends of the first flange, the resilient member has two protrusions extending therefrom, the blocks and the protrusions contact an underside of the second tubular portion of the outer tube.

* * * * *